US008216011B2

(12) United States Patent
Ogasawara et al.

(10) Patent No.: US 8,216,011 B2
(45) Date of Patent: Jul. 10, 2012

(54) OUTBOARD ENGINE UNIT

(75) Inventors: Ryo Ogasawara, Wako (JP); Hiroshi Yamamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 257 days.

(21) Appl. No.: 12/771,062

(22) Filed: Apr. 30, 2010

(65) Prior Publication Data

US 2010/0285708 A1 Nov. 11, 2010

(30) Foreign Application Priority Data

May 7, 2009 (JP) ..... P2009-113032

(51) Int. Cl.
*B63H 21/00* (2006.01)
*B63B 1/00* (2006.01)

(52) U.S. Cl. ..... 440/89 R; 114/271

(58) Field of Classification Search ..... 440/89 R, 440/89 D, 52, 66, 76, 82; 114/271
See application file for complete search history.

(56) References Cited

U.S. PATENT DOCUMENTS 2,442,728 A * 6/1948 Kiekhaefer ..... 440/78
6,010,380 A * 1/2000 Wollard ..... 440/89 R

FOREIGN PATENT DOCUMENTS

JP 07-165181 A 6/1995

* cited by examiner

*Primary Examiner* — Lars A Olson
*Assistant Examiner* — Anthony Wiest
(74) *Attorney, Agent, or Firm* — Arent Fox LLP

(57) ABSTRACT

Outboard engine unit includes: an anti-splash plate and an anti-cavitation plate provided on a gear case at a vertical interval from each other and extending horizontally from the gear case; an exhaust port provided in a side surface of the gear case for discharging exhaust gas from an engine; and a protruding section provided on the side surface of the gear case at a position located rearwardly of the exhaust port, the protruding section protruding laterally outwardly from the side surface for changing a direction of water flows flowing along the side surface.

3 Claims, 6 Drawing Sheets

(COMPARATIVE EXAMPLE)

(EMBODIMENT)

OUTBOARD ENGINE UNIT

FIELD OF THE INVENTION

The present invention relates to outboard engine units having exhaust ports near an anti-cavitation plate.

BACKGROUND OF THE INVENTION

Outboard engine units have exhaust ports for discharging exhaust gas from an engine, one example of which is disclosed in Japanese Patent Application Laid-Open Publication No. HEI-07-165181 (JP H07-165181 A).

FIG. 7 is a view explanatory of the outboard engine unit 100 disclosed in JP H07-165181 A. In the disclosed outboard engine unit 100, exhaust gas from an engine passes through an exhaust passage 102, provided vertically within an extension case 101, as indicated by arrow (1) and is then discharged to the outside through an exhaust port 104, provided in a gear case 103, as indicated by arrow (2).

Further, a fallaway or separation region (i.e., vertical region caused by separation of water flows) 106 would occur behind the gear case 103 by water flows produced by a propeller 105. Further, vortex water flows produced by an anti-cavitation plate 107 would join the propeller-produced water flows in the separation region 106 while sucking in the discharged engine exhaust gas. If the vortexes sucked into the separation region 106 are released to the atmosphere, unwanted noise (sound) can occur. Therefore, there has been a need for an outboard engine unit which can reduce unwanted noise.

SUMMARY OF THE INVENTION

In view of the foregoing prior art problems, it is an object of the present invention to provide an improved outboard engine unit which can reduce unwanted noise produced by vortex water flows having engine exhaust gas sucked therein.

In order to accomplish the above-mentioned object, the present invention provides an improved outboard engine unit, which comprises: an anti-splash plate and an anti-cavitation plate provided on a gear case at a vertical interval from each other and extending horizontally from the gear case; an exhaust port provided in a side surface of the gear case for discharging exhaust gas from an engine; and a protruding section provided on the side surface of the gear case at a position located rearwardly of the exhaust port, the protruding section protruding laterally outwardly from the side surface for changing a direction of water flows flowing along the side surface.

According to the present invention, water flows flowing along the side surface of the gear case are held back and changed in direction, i.e. diverted, by the protruding section. Thus, the present invention can reduce the amount of water flowing into a separation region behind the gear case, so that the separation region can be reduced in size. As a result, the present invention can reduce vortex water flows having exhaust gas sucked therein, to thereby reduce unwanted noise.

Preferably, the protruding section has, as viewed in plan, a first surface lying perpendicularly to a horizontal, front-to-rear central axis of the gear case, a second surface lying along the central axis, and a gently curved surface interconnecting the first surface and the second surface. If the first and second surfaces of each of the protruding sections are interconnected by a sharply-angled surface, new vortexes and turbulence of water would be produced by the sharply-angled surface.

However, the present invention, where the first and second surfaces of the protruding section are interconnected by the gently curved surface, can reliably prevent such new vortexes and turbulence of water.

The protruding section provided on the side surface of the gear case diverts the water flows, flowing along the side surface, away from the central axis of the gear case and hence away from a separation region of the water flows behind the gear case.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

A preferred embodiment of the present invention will be described in detail below, by way of example only, with reference to the accompanying drawings, in which:

FIGS. 6A and 6B are explanatory of behavior of the embodiment of the outboard engine unit, of which FIG. 6A is a sectional plan view showing a conventional comparative example of a gear case while FIG. 6B is a sectional plan view showing the gear case employed in the embodiment of the invention.

DETAILED DESCRIPTION OF THE PREFERRED EMBODIMENT

Figure 1:
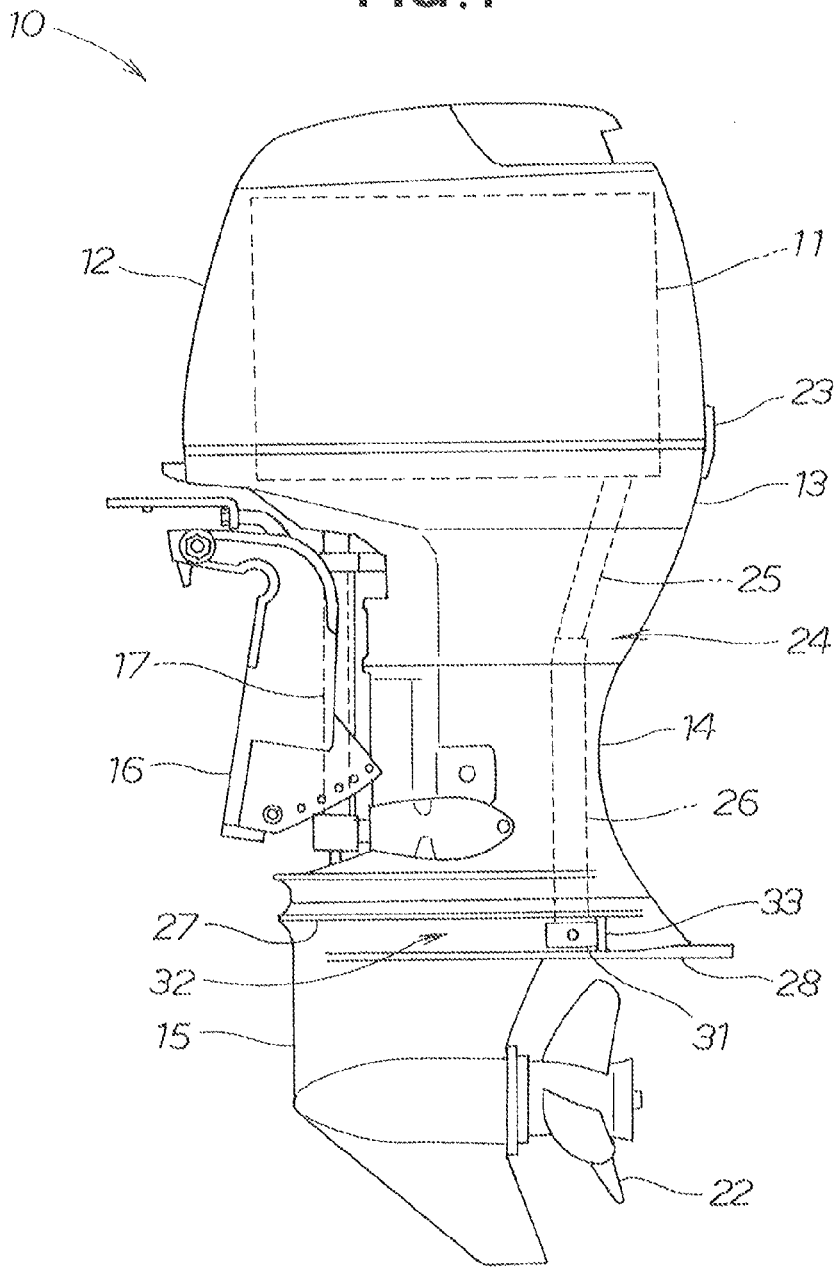
FIG. 1 is a side view showing an overall arrangement of an outboard engine unit according to an embodiment of the present invention.

Reference is now made to FIG. 1 showing in side elevation an overall arrangement of an outboard engine unit according to an embodiment of the present invention. As shown, the outboard engine unit 10 includes an engine 11 provided in an upper section of the unit 10. The engine 11 is a vertically placed engine with a cylinder and piton oriented horizontally and with a crankshaft and cam shaft oriented vertically. A direction in which a boat, having the outboard engine unit 10 mounted thereon, travels forward is a leftward direction in the figure.

The outboard engine unit 10 also includes: an upper engine cover 12 that covers an upper portion of the engine 11; a lower engine cover 13 disposed under the upper engine cover 12 to cover a lower portion of the engine 11; an extension case 14 disposed under the lower engine cover 13; and a gear case 15 disposed under the extension case 14.

The outboard engine unit 10 includes an outboard engine body 21 mounted via a vertical swivel shaft 17 to a stern bracket 16 that is in turn fixedly connected to a hull or body of the boat, and the engine body 21 is horizontally pivotable relative to the stern bracket 16 up to a predetermined maximum steered angle about the swivel shaft 17.

Behind the gear case 15 is disposed a propeller 22 rotatable by power produced by the engine 11 to provide propelling power. The propeller 22 is switchable between forward rotation and reverse rotation via a pair of dog clutches, to thereby provide forward or rearward propelling power.

The upper engine cover 12 is mounted to the lower engine cover 13 by means of a rear fastener 23 with a hook engaged with a front inner surface of the lower engine cover 13.

An exhaust system 24, which is provided under the engine 11, includes an exhaust pipe 25 connected to an exhaust manifold (not shown), an exhaust passage 26 formed inside the lower engine cover 13, extension case 14 and gear case 15, and left and right exhaust ports (only the left exhaust ports is shown in FIG. 1) 31 provided between an anti-splash plate 27 and an anti-cavitation plate 28. The anti-splash plate 27 and the anti-cavitation plate 28 are disposed at a vertical interval (i.e., vertically spaced-apart relation) from each other and extend horizontally from the gear case 15.

Exhaust gas from the engine 11 passes through the exhaust pipe 25 and exhaust passage 26 to be discharged to the outside through the exhaust ports 31. Cooling water having cooled the engine 11 passes through the exhaust passage 26 to be discharged to the outside through the exhaust port 31 together with the engine exhaust gas.

Figure 2:
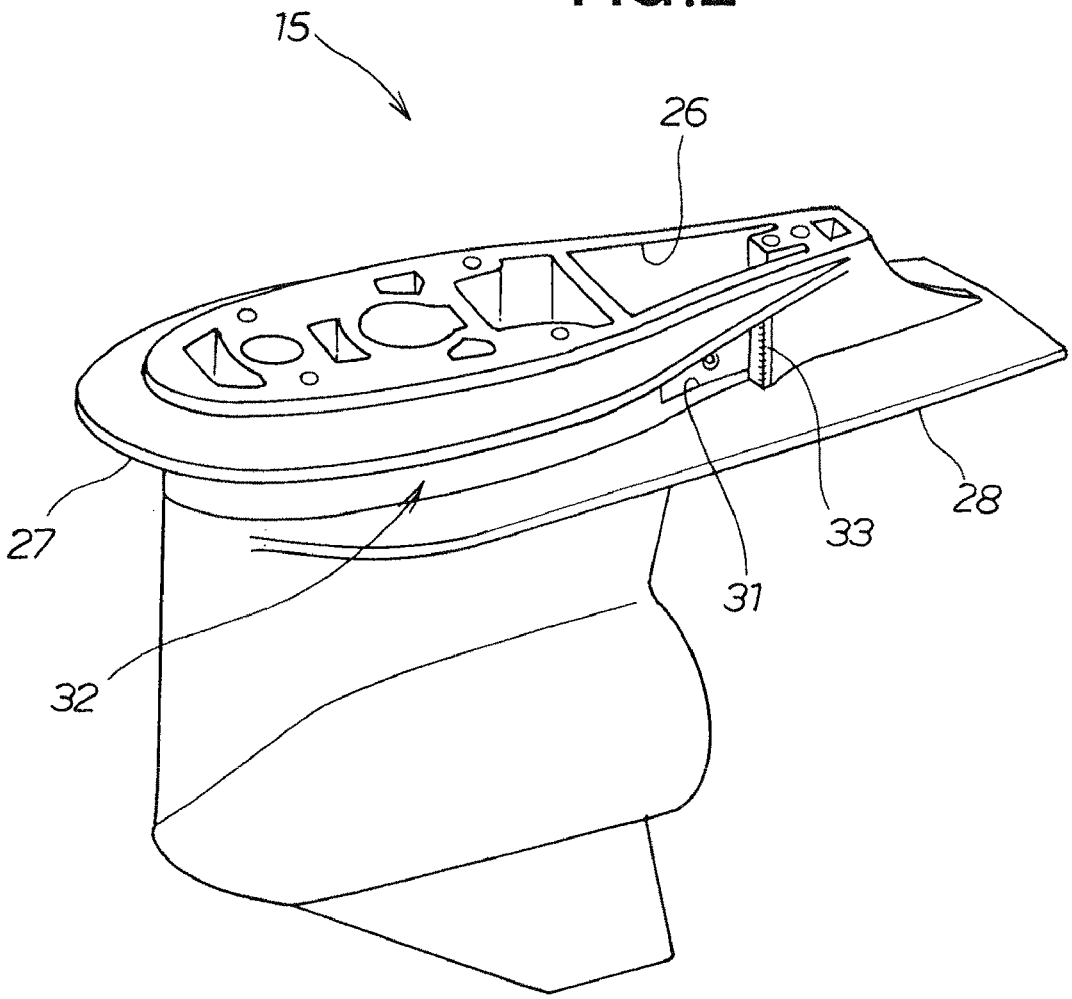
FIG. 2 is a perspective view of a gear case employed in the embodiment of the outboard engine unit.

The following describe the gear case 15 with reference to FIG. 2 that is a perspective view of the gear case 15. As shown, the anti-splash plate 27 and the anti-cavitation plate 28 are provided on and extend horizontally along the outer surface of the gear case 15, and the exhaust ports 31, through which exhaust gas from the engine 11 (FIG. 1) is discharged, are provided between the anti-splash plate 27 and the anti-cavitation plate 28.

The exhaust ports (only one of which is shown in FIG. 2) 31 are formed in opposite side surfaces 32 of the gear case 15, and protruding sections (only one of which is shown in FIG. 2) 33 are formed on the corresponding side surfaces 32 to protrude laterally outwardly from the corresponding side surfaces and located rearwardly of the corresponding exhaust ports 31 for changing a direction of, i.e. diverting, water flows flowing along the side surfaces 32.

Figure 3:
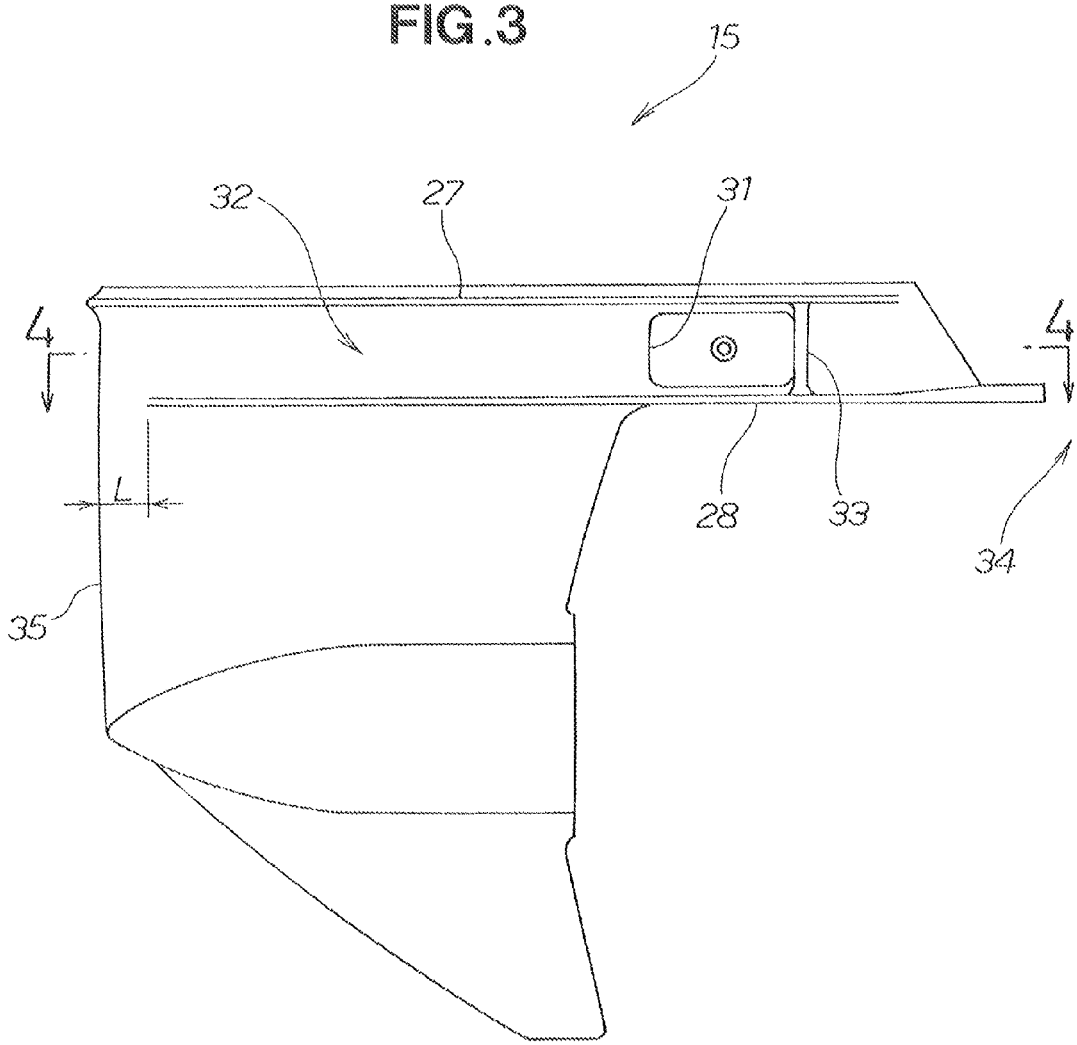
FIG. 3 is a front view of the gear case employed in the embodiment of the outboard engine unit.

The following describe water flows along the side surfaces 32 of the gear case 15, with reference to FIG. 3 that is a front view of the gear case 15. As shown in FIG. 3, during travel of the boat in a front-to-rear direction (left-to-right direction of the figure), a separation region 34 would occur behind the gear case 14 due to water flows produced by the propeller 22 (FIG. 1). Further, vortex water flows would be produced by the anti-cavitation plate 28 and join the propeller-produced water flows in the separation region 34 while sucking in the exhaust gas discharged through the exhaust ports 31.

Further, the frond end of the anti-cavitation plate 28 is located rearwardly a distance L from the front end 35 of the gear case 15.

Figure 4:
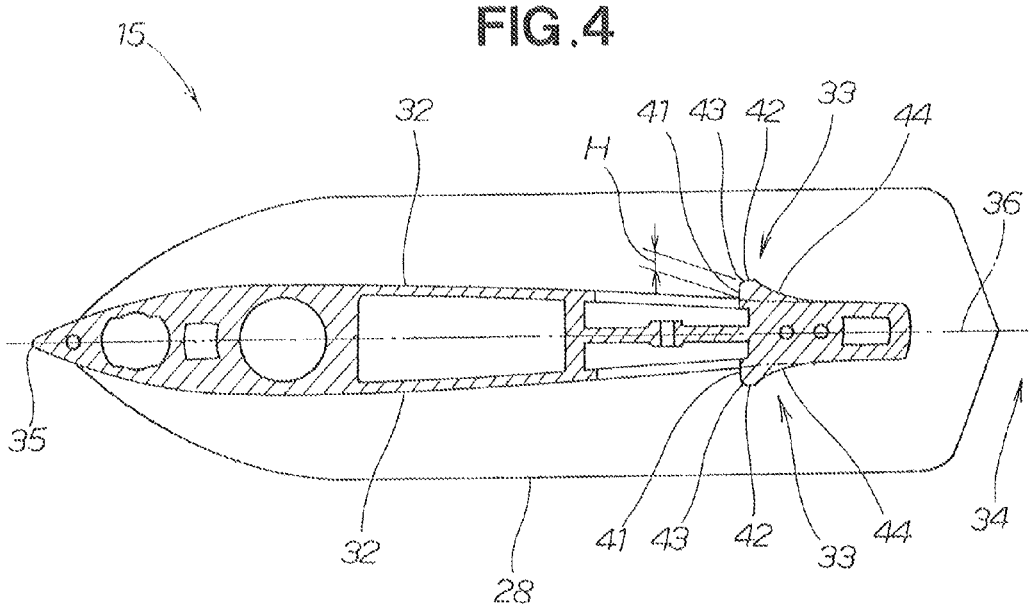
FIG. 4 is a sectional view taken along line 4-4 of FIG. 3.

The following describe in detail a shape of each of the protruding sections 33 of the gear case 15, with reference to FIG. 4 that is a sectional view taken along the 4-4 line of FIG. 3. As shown in FIG. 4, each of the protruding section 33 has: a first surface 41 lying perpendicularly to a horizontal, front-to-rear central axis 36 of the gear case 15; a second surface 42 lying along the central axis 36; a gently curved surface 43 gently interconnecting the front end of the second surface 42 and the first surface 41; and a concavely curved surface 44 interconnecting the rear end of the second surface 42 and the side surface 32.

Preferably, as viewed in the plan view of FIG. 4, a dimension H from the side surface 32 to the second surface 42, i.e. a height H of the protruding section 33, is 10 mm. The inventors of the present invention etc. studied relationship between the height H of the protruding section 33 and noise (sound) level, in order to ascertain behavior of the protruding section 33.

Figure 5:
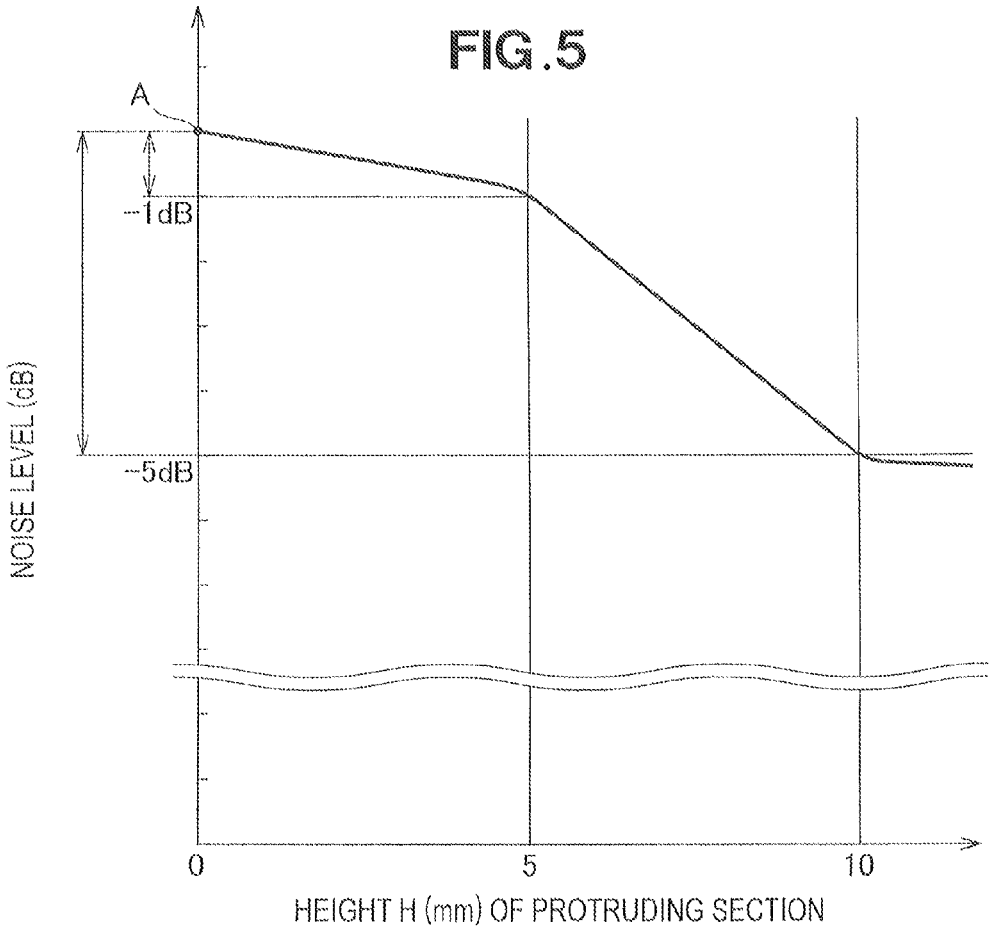
FIG. 5 is a graph explanatory of how noise level reduction is achieved in the embodiment of the outboard engine unit.

The following describe the studied relationship between the height H of the protruding section 33 and the noise level, with reference to FIG. 5.

As illustrated in FIG. 5, a noise level measured in a case where each of the protruding sections 33 of FIG. 4 has the height H of zero was set as a reference noise level A. The noise reducing effect achieved by the instant embodiment is relatively low in a case where the height of the protruding section 33 is in a range of 0-5 mm; particularly, where the height H is 5 mm, the noise level is reduced by 1 dB from the reference noise level A. If the height H is increased above 5 mm, the noise reducing effect achieved by the instant embodiment can be enhanced significantly. Further, if the height H is increased above 10 mm, the noise reducing effect achieved by the instant embodiment can be kept generally constant. For these reasons, it is preferable that the height be set at 10 mm. Thus, the inventors etc. could ascertain that the protruding sections 33 can contribute much to reduction of the noise.

Figure 6A:
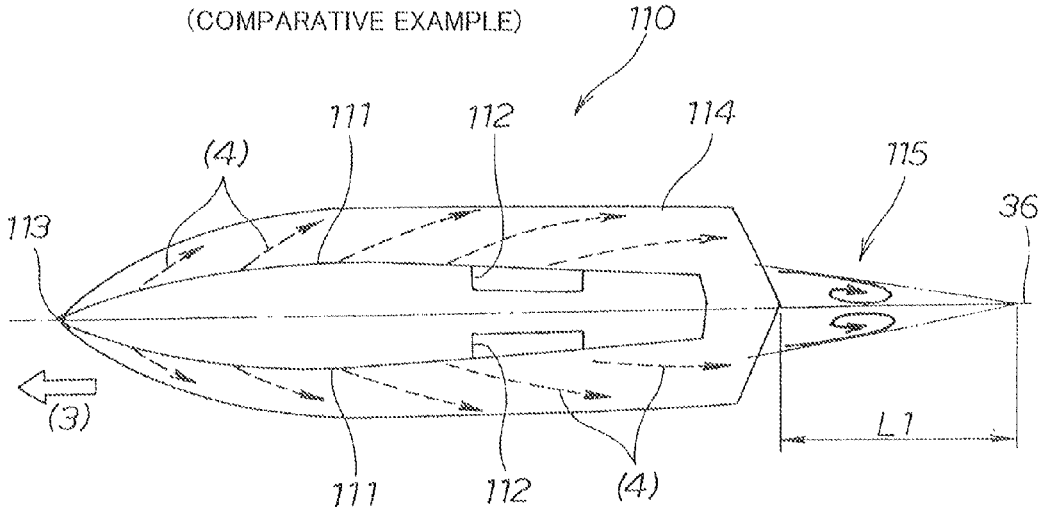

The following discuss a mechanism via which the instant embodiment can reduce unwanted noise, with reference to FIG. 6. FIG. 6A is a sectional plan view showing a conventional comparative example of a gear case 110. Exhaust ports 112 for discharging exhaust gas are provided in opposite side surfaces 111 of the gear case 110, and an anti-cavitation plate 114 is formed on the gear case 110 to extend from a front end portion 113 of the gear case 110.

As the outboard engine unit having the gear case 110 moves forward, i.e. in a direction of arrow (3), vortex water flows would occur along the side surfaces 111 of the gear case 110 as indicated by arrows (4). Because the vortex water flows are not held back by the side surfaces 111, a great amount of the vortex water flows rearward as-is, so that a separation region 115 behind the gear case 110 would have a relatively great size. In the gear case 110 of FIG. 6A, the separation region 115 has a length L1 in the front-rear direction. The vortex water flows proceed to the separation region 115 while sucking in engine exhaust gas discharged through the exhaust ports 112. Because many of the vortex water flows are released to the atmosphere in the separation region 115, noise (sound) can easily occur.

Figure 6B:
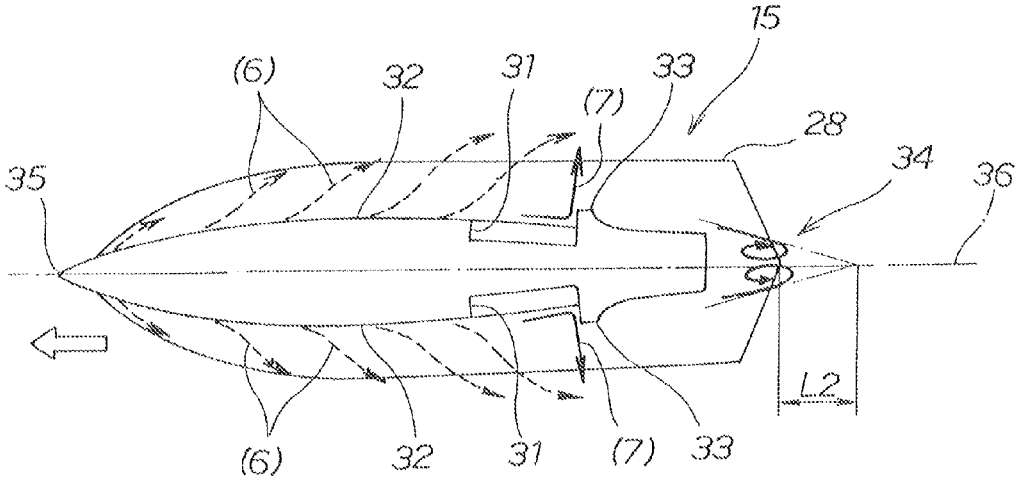
Figure 7:
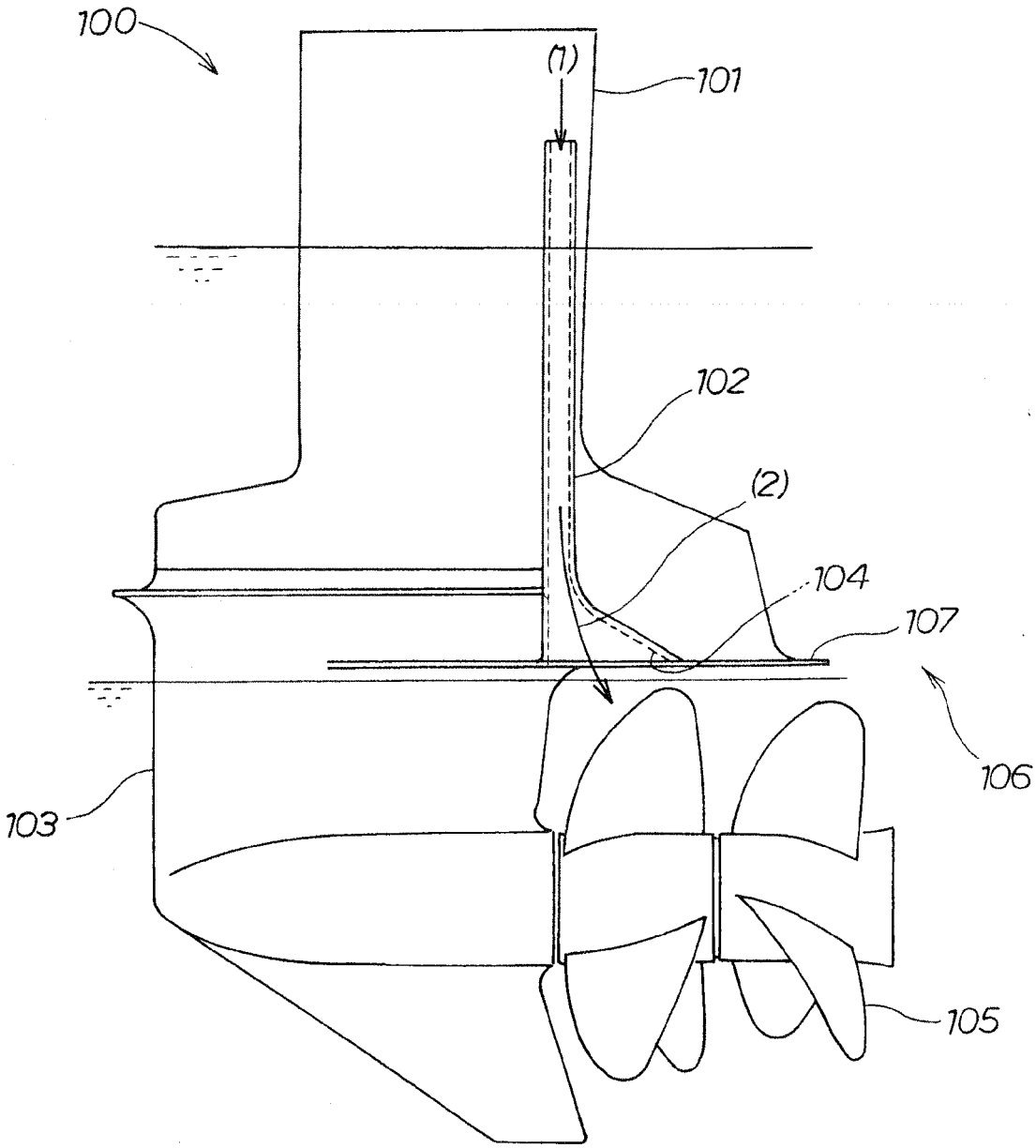
FIG.7 (PRIOR ART)
FIG. 7 illustrates a conventionally-known outboard engine unit.

FIG. 6B is a sectional plan view showing the gear case 15 employed in the instant embodiment of the invention. As the outboard engine unit having the gear case 15 moves forward, i.e. in a direction of arrow (5), vortex water flows would occur along the side surfaces 32 of the gear case 15 as indicated by arrows (6). The vortex water flows along the side surfaces 32 are changed in direction or diverted, away from the horizontal, front-to-rear central axis 36 of the gear case 15 and hence away from a separation region of the water flows behind the gear case 15, by the protruding sections 33 as indicated by arrows (7). In this way, the vortex water flows are held back and diverted, so that the separation region 34 behind the gear case 15 can be decreased in size. Specifically, the separation region 34 in the embodiment has a decreased length L2 in FIG. 6B; namely, the length L2 is smaller than the length L1 in FIG. 6A (i.e., L2<L1). Although the vortex water flows suck in the engine exhaust gas discharged through the exhaust ports 31, the protruding sections 33 can reduce the amount of water flowing into the separation region 34, so that less of the vortex water flows are released to the atmosphere in the separation region 34. As a result, the instant embodiment can effectively reduce unwanted noise.

Whereas the embodiment of the invention has been described above in relation to the case where the height H of each of the protruding sections 33 is 10 mm, the height H may be any other suitable length, such as 9 mm or 11 mm, as long as the protruding sections 33 can change the direction of the water flows along the side surfaces 32 of the gear case 15 to thereby reduce the size of the separation region 34.

The present invention is well suited for application to outboard engines having at least one exhaust port near an anti-cavitation plate.

What is claimed is:

1. An outboard engine unit comprising:

an anti-splash plate and an anti-cavitation plate provided on a gear case at a vertical interval from each other and extending horizontally from the gear case;

an exhaust port provided in a side surface of the gear case for discharging exhaust gas from an engine; and a protruding section provided on the side surface of the gear case at a position located rearwardly of the exhaust port, the protruding section protruding laterally outwardly from the side surface for changing a direction of water flows flowing along the side surface.

2. The outboard engine unit according to claim 1, wherein the protruding section has, as viewed in plan, a first surface lying perpendicularly to a horizontal, front-to-rear central axis of the gear case, a second surface lying along the central axis, and a gently curved surface interconnecting the first surface and the second surface.

3. The outboard engine unit according to claim 2, wherein the protruding section diverts the water flows, flowing along the side surface, away from the central axis of the gear case.

* * * * *